US009202405B2

(12) United States Patent
Liao et al.

(10) Patent No.: US 9,202,405 B2
(45) Date of Patent: Dec. 1, 2015

(54) DISPLAY PANEL WITH VARIED SUBPIXEL ARRANGEMENT SEQUENCES

(71) Applicant: Au Optronics Corporation, Hsinchu (TW)

(72) Inventors: Yi-Yang Liao, Taichung (TW); Chia-Wei Kuo, Kaohsiung (TW); Kun-Ying Shin, Hsinchu (TW); Ching-Huan Lin, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 14/283,239

(22) Filed: May 21, 2014

(65) Prior Publication Data

US 2015/0228214 A1 Aug. 13, 2015

(30) Foreign Application Priority Data

Feb. 12, 2014 (TW) ..... 103104610 A

(51) Int. Cl.
*G09G 3/20* (2006.01)

(52) U.S. Cl.
CPC ..... *G09G 3/2003* (2013.01); *G09G 2300/0452* (2013.01)

(58) Field of Classification Search
CPC ..... G09G 3/2074; G09G 2300/0439; G09G 2300/0452
See application file for complete search history.

(56) References Cited

U.S. PATENT DOCUMENTS

| | | | | |
|---|---|---|---|---|
| 7,663,299 | B2 | 2/2010 | Chao et al. | |
| 8,120,629 | B2 * | 2/2012 | Maruyama | G09G 3/2025 345/694 |
| 8,164,605 | B2 * | 4/2012 | Hsieh | G09G 3/3607 345/694 |
| 2007/0152997 | A1 * | 7/2007 | Lee | 345/419 |
| 2007/0291054 | A1 * | 12/2007 | Shin | G09G 3/003 345/694 |
| 2008/0198185 | A1 * | 8/2008 | Maruyama | G09G 3/2025 345/698 |
| 2009/0207328 | A1 * | 8/2009 | Hur et al. | 349/37 |
| 2010/0283807 | A1 * | 11/2010 | Hsieh | G09G 3/3607 345/694 |
| 2014/0002431 | A1 * | 1/2014 | Shibata | G09G 3/3614 345/208 |
| 2014/0104301 | A1 * | 4/2014 | Nakagawa | G09G 3/2003 345/589 |
| 2014/0152634 | A1 * | 6/2014 | Shibata | G09G 3/3614 345/209 |

FOREIGN PATENT DOCUMENTS

| | | |
|---|---|---|
| CN | 101661128 | 3/2010 |
| JP | 2007-183611 | 7/2007 |
| JP | 2010-041720 | 2/2010 |
| JP | 2012-128352 | 7/2012 |
| TW | 200842800 | 11/2008 |

* cited by examiner

*Primary Examiner* — Gene W Lee
(74) *Attorney, Agent, or Firm* — Jianq Chyun IP Office

(57) ABSTRACT

A display panel including a plurality of unit regions is provided. The unit regions are arranged along a first direction and a second direction to form a plurality of columns and a plurality of rows. Each of the unit regions of the display panel includes a plurality of first color sub-pixels, a plurality of second color sub-pixels, and a plurality of third color sub-pixels. In any of the rows, a first pitch between any one of the first color sub-pixels and a next of the first color sub-pixels has at least four kinds of distances.

19 Claims, 21 Drawing Sheets

| | | | | | | | | | | | |
|---|---|---|---|---|---|---|---|---|---|---|---|
| PU1 | PU4 | PU2 | PU5 | PU4 | PU3 | PU6 | PU3 | PU5 | PU5 | PU4 | PU2 |
| PU2 | PU6 | PU5 | PU4 | PU2 | PU1 | PU3 | PU1 | PU1 | PU1 | PU4 | PU5 |
| PU6 | PU3 | PU1 | PU1 | PU1 | PU3 | PU4 | PU4 | PU4 | PU4 | PU3 | PU1 |
| PU1 | PU4 | PU3 | PU3 | PU1 | PU4 | PU5 | PU5 | PU4 | PU2 | PU4 | PU6 |
| PU6 | PU5 | PU6 | PU6 | PU4 | PU1 | PU3 | PU2 | PU6 | PU2 | PU5 | PU2 |
| PU5 | PU6 | PU6 | PU6 | PU4 | PU3 | PU2 | PU2 | PU6 | PU1 | PU6 | PU2 |
| PU3 | PU1 | PU5 | PU1 | PU1 | PU6 | PU2 | PU2 | PU4 | PU5 | PU4 | PU6 |
| PU6 | PU5 | PU3 | PU2 | PU5 | PU3 | PU3 | PU6 | PU5 | PU1 | PU1 | PU3 |
| PU4 | PU3 | PU5 | PU4 | PU4 | PU3 | PU1 | PU2 | PU3 | PU5 | PU5 | PU1 |
| PU4 | PU6 | PU5 | PU3 | PU2 | PU4 | PU3 | PU1 | PU5 | PU4 | PU1 | PU6 |
| PU1 | PU6 | PU1 | PU6 | PU5 | PU2 | PU3 | PU1 | PU6 | PU5 | PU2 | PU3 |
| PU1 | PU6 | PU5 | PU4 | PU2 | PU2 | PU5 | PU3 | PU1 | PU4 | PU5 | PU3 |

U

D1

D2

FIG. 4B

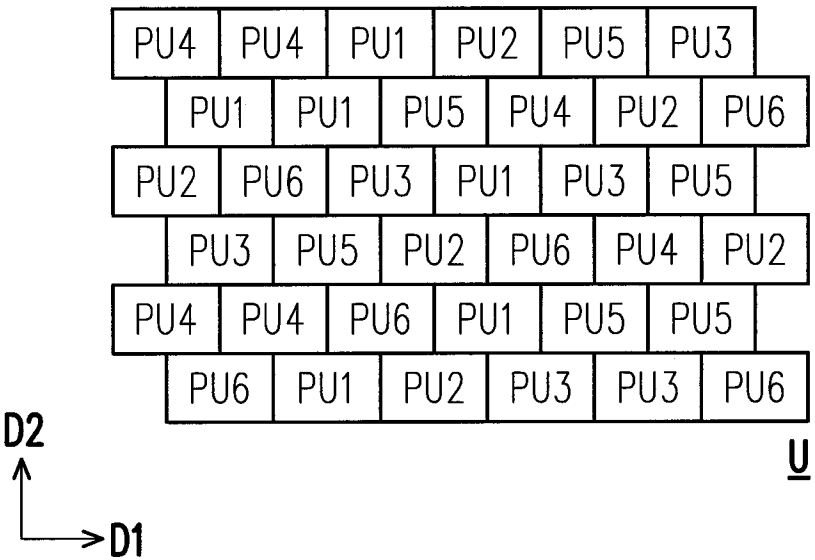
PU4
PU4
PU1
PU2
PU5
PU3
PU1
PU1
PU5
PU4
PU2
PU6
PU2
PU6
PU3
PU1
PU3
PU5
PU4
PU6
PU3
PU5
PU2
PU1
PU4
PU4
PU6
PU2
PU5
PU1
PU3
PU6
PU2
PU5
PU4
PU6
PU3
PU5
PU2

| | | | | | | | | | | | | | | | | | | | | | | | |
|---|---|---|---|---|---|---|---|---|---|---|---|---|---|---|---|---|---|---|---|---|---|---|---|
| PU1' | PU14' | PU5' | PU20' | PU15' | PU12' | PU9' | PU22' | PU20' | PU18' | PU5' | PU21' | PU18' | PU13' | PU8' | PU1' | PU3' | PU9' | PU4' | PU4' | PU24' | PU11' | PU3' | PU1' |
| PU1' | PU10' | PU13' | PU14' | PU15' | PU15' | PU4' | PU16' | PU11' | PU9' | PU2' | PU15' | PU19' | PU20' | PU13' | PU8' | PU22' | PU18' | PU23' | PU23' | PU13' | PU4' | PU12' | PU6' |
| PU21' | PU6' | PU19' | PU21' | PU24' | PU24' | PU15' | PU10' | PU7' | PU8' | PU21' | PU1' | PU10' | PU3' | PU17' | PU2' | PU1' | PU23' | PU7' | PU7' | PU15' | PU17' | PU21' | PU18' |
| PU12' | PU5' | PU18' | PU12' | PU11' | PU23' | PU18' | PU3' | PU15' | PU10' | PU18' | PU15' | PU14' | PU9' | PU4' | PU6' | PU11' | PU20' | PU13' | PU24' | PU19' | PU9' | PU5' | PU16' |
| PU12' | PU2' | PU17' | PU13' | PU4' | PU23' | PU4' | PU22' | PU17' | PU8' | PU11' | PU2' | PU24' | PU17' | PU4' | PU22' | PU20' | PU14' | PU5' | PU5' | PU20' | PU12' | PU4' | PU13' |
| PU18' | PU10' | PU7' | PU14' | PU17' | PU19' | PU18' | PU12' | PU3' | PU9' | PU21' | PU1' | PU13' | PU16' | PU11' | PU3' | PU23' | PU23' | PU14' | PU9' | PU12' | PU9' | PU21' | PU8' |
| PU11' | PU7' | PU24' | PU8' | PU18' | PU14' | PU5' | PU19' | PU21' | PU10' | PU13' | PU22' | PU1' | PU24' | PU14' | PU2' | PU13' | PU5' | PU21' | PU16' | PU16' | PU5' | PU21' | PU3' |
| PU3' | PU18' | PU8' | PU23' | PU7' | PU9' | PU4' | PU18' | PU21' | PU17' | PU15' | PU18' | PU7' | PU4' | PU1' | PU2' | PU20' | PU21' | PU6' | PU3' | PU14' | PU1' | PU3' | PU11' |
| PU19' | PU17' | PU14' | PU2' | PU11' | PU5' | PU17' | PU7' | PU11' | PU6' | PU14' | PU13' | PU16' | PU4' | PU13' | PU24' | PU17' | PU23' | PU5' | PU9' | PU5' | PU24' | PU11' | PU24' |
| PU3' | PU16' | PU3' | PU11' | PU23' | PU2' | PU22' | PU7' | PU6' | PU19' | PU10' | PU5' | PU16' | PU15' | PU11' | PU12' | PU15' | PU16' | PU21' | PU20' | PU15' | PU18' | PU14' | PU10' |
| PU5' | PU18' | PU14' | PU22' | PU6' | PU5' | PU15' | PU17' | PU15' | PU9' | PU12' | PU2' | PU18' | PU15' | PU15' | PU17' | PU20' | PU4' | PU14' | PU21' | PU22' | PU15' | PU18' | PU2' |
| PU17' | PU24' | PU8' | PU14' | PU8' | PU5' | PU3' | PU21' | PU21' | PU18' | PU4' | PU8' | PU2' | PU2' | PU16' | PU20' | PU14' | PU11' | PU10' | PU8' | PU12' | PU13' | PU4' | PU8' |
| PU18' | PU8' | PU20' | PU24' | PU21' | PU18' | PU8' | PU23' | PU4' | PU2' | PU19' | PU13' | PU15' | PU23' | PU2' | PU22' | PU16' | PU8' | PU3' | PU13' | PU6' | PU7' | PU23' | PU14' |
| PU16' | PU3' | PU12' | PU10' | PU12' | PU20' | PU13' | PU10' | PU17' | PU13' | PU15' | PU10' | PU1' | PU17' | PU3' | PU15' | PU21' | PU12' | PU18' | PU12' | PU10' | PU19' | PU14' | PU9' |
| PU23' | PU16' | PU5' | PU9' | PU4' | PU18' | PU23' | PU15' | PU1' | PU8' | PU2' | PU16' | PU4' | PU21' | PU21' | PU15' | PU18' | PU21' | PU1' | PU4' | PU17' | PU15' | PU6' | PU2' |
| PU5' | PU15' | PU9' | PU8' | PU9' | PU16' | PU20' | PU20' | PU13' | PU15' | PU20' | PU22' | PU4' | PU16' | PU10' | PU7' | PU4' | PU21' | PU2' | PU11' | PU14' | PU8' | PU14' | PU6' |
| PU8' | PU3' | PU20' | PU4' | PU7' | PU19' | PU22' | PU19' | PU18' | PU15' | PU9' | PU21' | PU6' | PU21' | PU6' | PU6' | PU14' | PU24' | PU2' | PU2' | PU13' | PU11' | PU3' | PU7' |
| PU22' | PU6' | PU4' | PU4' | PU23' | PU2' | PU2' | PU2' | PU9' | PU22' | PU10' | PU11' | PU23' | PU21' | PU13' | PU21' | PU17' | PU10' | PU7' | PU1' | PU13' | PU23' | PU10' | PU6' |
| PU15' | PU7' | PU17' | PU23' | PU11' | PU22' | PU1' | PU23' | PU15' | PU19' | PU14' | PU4' | PU6' | PU10' | PU1' | PU11' | PU2' | PU16' | PU21' | PU2' | PU20' | PU16' | PU17' | PU20' |
| PU13' | PU17' | PU4' | PU17' | PU18' | PU19' | PU1' | PU21' | PU16' | PU17' | PU3' | PU14' | PU23' | PU2' | PU7' | PU4' | PU24' | PU15' | PU8' | PU23' | PU9' | PU17' | PU6' | PU4' |
| PU6' | PU13' | PU22' | PU3' | PU22' | PU11' | PU2' | PU19' | PU5' | PU24' | PU19' | PU21' | PU6' | PU11' | PU1' | PU19' | PU3' | PU10' | PU8' | PU24' | PU1' | PU7' | PU5' | PU6' |
| PU4' | PU15' | PU22' | PU23' | PU5' | PU19' | PU16' | PU16' | PU22' | PU11' | PU23' | PU16' | PU4' | PU16' | PU14' | PU11' | PU23' | PU13' | PU14' | PU13' | PU7' | PU10' | PU9' | PU1' |
| PU20' | PU5' | PU2' | PU10' | PU15' | PU2' | PU5' | PU4' | PU16' | PU11' | PU15' | PU17' | PU11' | PU17' | PU10' | PU21' | PU15' | PU5' | PU23' | PU22' | PU10' | PU24' | PU5' | PU22' |
| PU14' | PU11' | PU16' | PU18' | PU2' | PU7' | PU7' | PU10' | PU22' | PU18' | PU18' | PU22' | PU10' | PU10' | PU22' | PU8' | PU10' | PU14' | PU9' | PU18' | PU18' | PU18' | PU18' | PU4' |

D2

D1

U

FIG. 11

DISPLAY PANEL WITH VARIED SUBPIXEL ARRANGEMENT SEQUENCES

CROSS-REFERENCE TO RELATED APPLICATION

This application claims the priority benefit of Taiwan application serial no. 103104610, filed on Feb. 12, 2014. The entirety of the above-mentioned patent application is hereby incorporated by reference herein and made a part of this specification.

BACKGROUND OF THE INVENTION

1. Field of the Invention

The invention relates to a panel, and particularly relates to a display panel.

2. Description of Related Art

With the advancement of science and technology, bulky cathode ray tube (CRT) displays have gradually fallen into disuse. Thus, display panels such as liquid crystal displays (LCDs), organic light emitting diode (OLED) displays, electro-phoretic displays (EPDs), and plasma display panels (PDPs), etc. are gradually becoming the mainstream displays of the next generation.

In addition, the technology of transparent display panels is now being actively developed. The transparent display panels refer to display panels that are transparent to a certain extent, so that the background behind the display panels can be clearly seen. The transparent displays are suitable for the windows of buildings and vehicles, and the display windows of shops. In addition to the inherent function of displaying with transparency, the transparent displays also have the potential of serving as information displays. Therefore, the transparent displays have garnered market attention.

In the conventional transparent display panels, sub-pixels of the same color only have a unified pitch in the vertical, horizontal, and oblique directions. The design with a unified pitch tends to result in interference or diffraction caused by background light passing through the sub-pixels of the same color, which renders blurred background images. As a result, the transmittance and clarity of the transparent display panels are influenced. Thus, how to develop and design transparent display panels with high transmittance and clarity has become an important issue for the researchers.

SUMMARY OF THE INVENTION

The invention provides a display panel having a preferable transmittance and clarity.

The invention provides a display panel, including a plurality of unit regions. The unit regions are arranged along a first direction and a second direction to form a plurality of columns and a plurality of rows. Each of the unit regions of the display panel includes a plurality of first color sub-pixels, a plurality of second color sub-pixels, and a plurality of third color sub-pixels. In any of the rows, a first pitch between any one of the first color sub-pixels and a next of the first color sub-pixels has at least four kinds of distances.

In view of the foregoing, since the sub-pixels of the same color in the display panel of the invention have the pitch with a plurality of different kinds of distances (and one kind of the color sub-pixels has the pitch with at least four kinds of distances), instead of a pitch with a unified distance, it is possible to prevent the background light passing through the sub-pixels of the same color and causing interference or diffraction that results in a blurred background image. Thus, the transmittance and clarity of the display panel are improved.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 3 to 5B are respectively schematic top views of unit regions formed by the pixel units shown in FIGS. 2A to 2F.

FIGS. 10 to 12 are respectively schematic top views of unit regions formed by the pixel units shown in FIGS. 9A to 9X.

DESCRIPTION OF THE EMBODIMENTS

Figure 1:
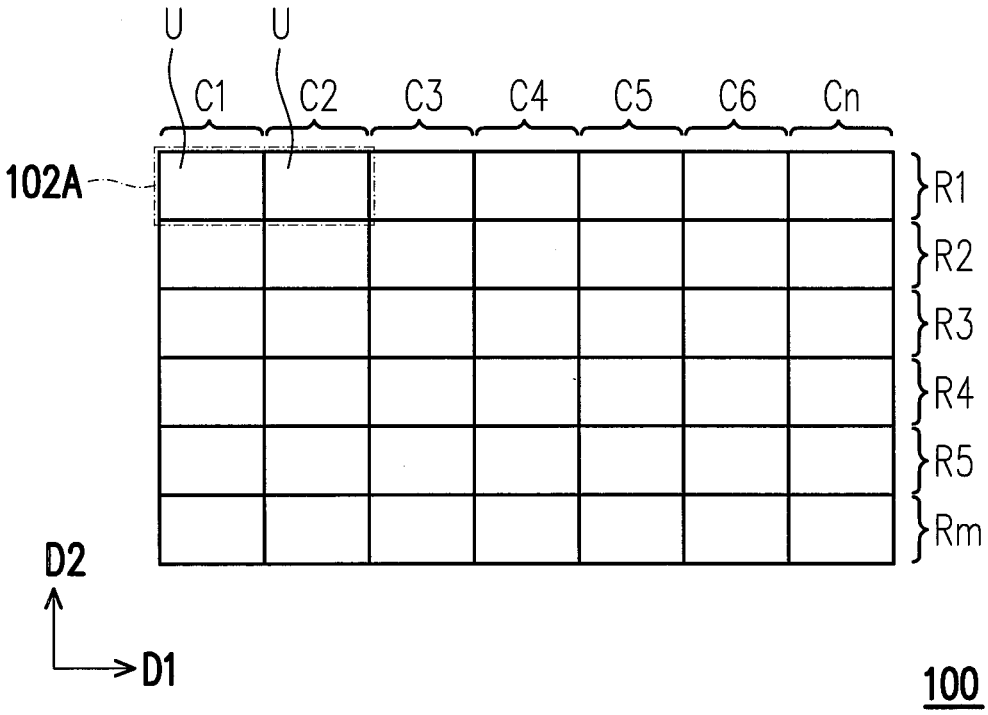
FIG. 1 is a schematic top view of a display panel according to the invention.
Figure 2A:
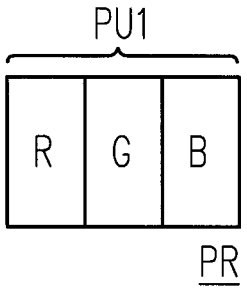
FIGS. 2A to 2F are schematic top views of six kinds of pixel units according to a first embodiment of the invention.
Figure 2B:
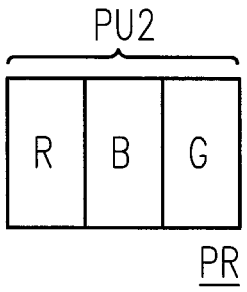
Figure 2C:
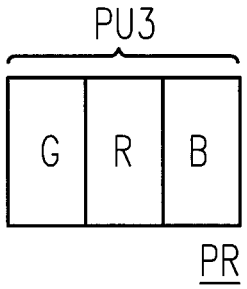
Figure 2D:
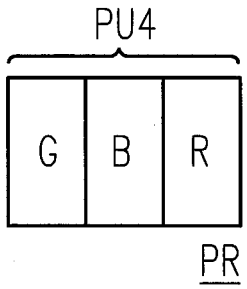
Figure 2E:
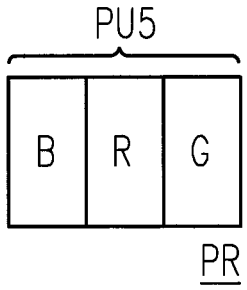
Figure 2F:
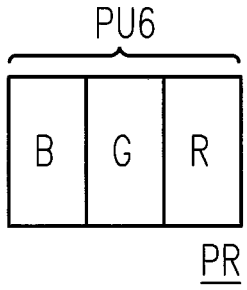

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic top view of a display panel according to the invention. FIGS. 2A to 2F are schematic top views of six kinds of pixel units according to a first embodiment of the invention. FIGS. 3 to 5B are respectively schematic top views of unit regions formed by the pixel units shown in FIGS. 2A to 2F.

Figure 3:
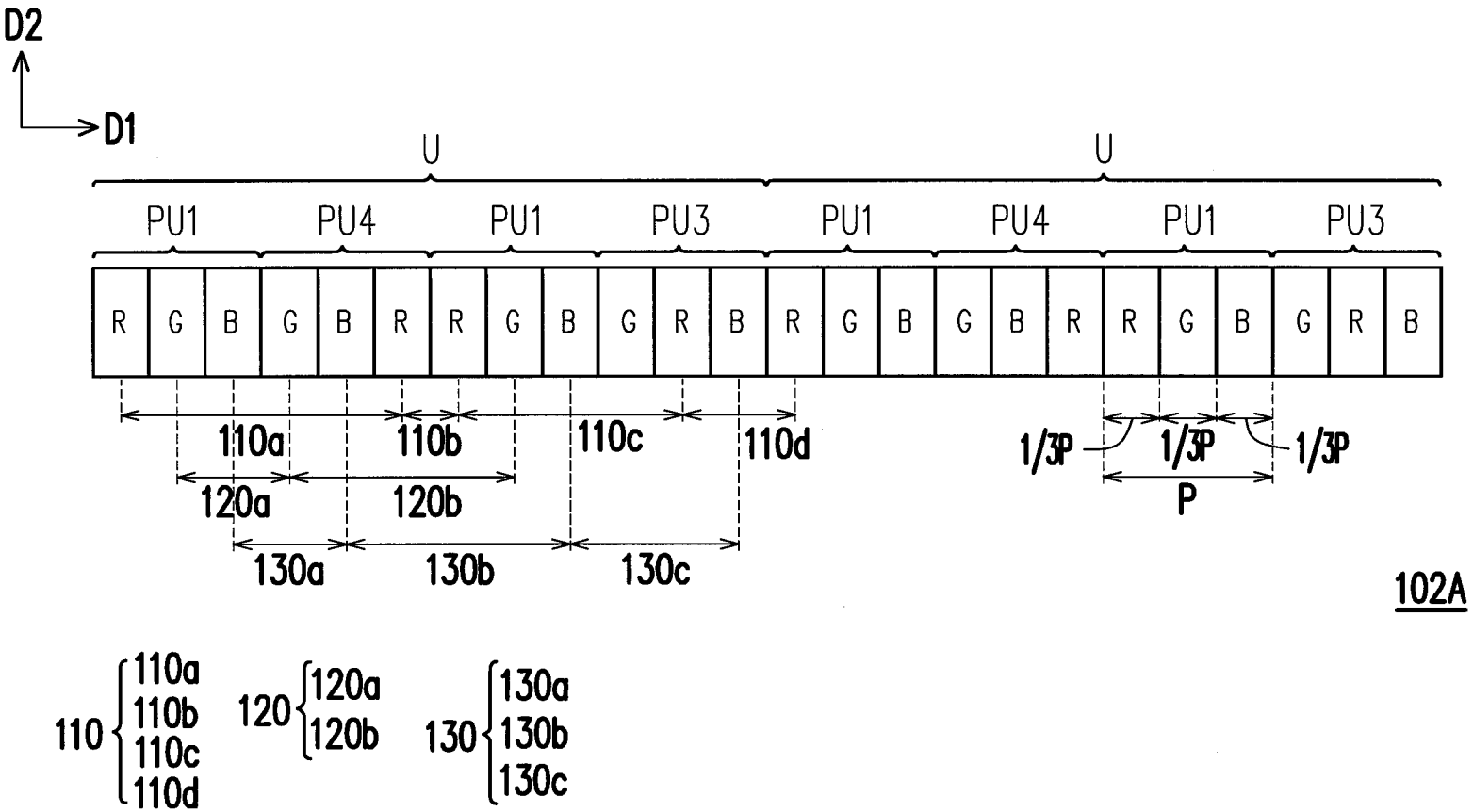

Referring to FIGS. 1 to 3 simultaneously, a display panel 100 is a transparent display panel, an organic electro-luminescence display panel, an electro-phoretic display panel, or other appropriate display panels. In the following, the display panel 100 as a transparent display panel is used as an example for further description.

The display panel 100 includes a plurality of unit regions U. The unit regions U are arranged along a first direction D1 to form a plurality of columns C1 to Cn, and are arranged along a second direction D2 to form a plurality of rows R1 to Rm. In FIG. 1, the columns C1 to Cn are arranged along the first direction D1, and the rows R1 to Rm are arranged along the second direction D2. Therefore, the columns C1 to Cn are termed as "column", and the rows R1 to Rm are termed as "row". However, the invention is not limited thereto. In another embodiment, the columns C1 to Cn are arranged along the second direction D2 and the rows R1 to Rm are arranged along the first direction D1. In other words, the columns C1 to Cn and the rows R1 to Rm are used to describe relative positions in an array arrangement instead of limiting the invention. Thus, the columns C1 to Cn and the rows R1 to Rm may be switched with respect to each other. In addition, by switching the columns C1 to Cn and rows R1 to Rm of FIG. 1, an array arrangement after 90-degree rotation is shown.

Each of the unit regions U of the display panel 100 includes a plurality of first color sub-pixels R, a plurality of second color sub-pixels G, and a plurality of third color sub-pixels B. In this embodiment, the first color sub-pixels R, the second color sub-pixels G, and the third color sub-pixels B respectively are red sub-pixels, green sub-pixels, and blue sub-pixels. However, the invention is not limited thereto. In other embodiments, the first color sub-pixels R, the second color sub-pixels G, and the third color sub-pixels B may be other appropriate colors or combinations. In addition, under a circumstance that the display panel 100 of the invention is an organic electro-luminescence display panel, the first color sub-pixels R, the second color sub-pixels G, and the third color sub-pixels B may respectively be sub-pixel structures of the organic electro-luminescence display panel, including components such as a scanning line, a data line, a power source line, an active device, a cathode layer, an organic luminescence layer, and an anode layer, etc. Under a circumstance that the display panel 100 of the invention is an electro-phoretic display panel, the first color sub-pixels R, the second color sub-pixels G, and the third color sub-pixels B may respectively be sub-pixel structures of the electro-phoretic display panel, including components such as a scanning line, a data line, an active device, a pixel electrode, an electro-phoretic display layer, and an opposite electrode, etc. As noted above, the invention does not limit the type of the display panel 100. Therefore, structures of the first color sub-pixels R, the second color sub-pixels G, and the third color sub-pixels B may differ according to the type of the display panel 100.

In addition, in this embodiment, one of the first color sub-pixels R, one of the second color sub-pixels G, and one of the third color sub-pixels B form a pixel PR. A length of each of the pixels PR in the first direction D1 is P, and a length of each of the color sub-pixels, including the first color sub-pixels R, the second color sub-pixels G, and the third color sub-pixels B, in the first direction D1 is 1/3P. In addition, as shown in FIGS. 2A to 2F, the first color sub-pixels R, the second color sub-pixels G, and the third color sub-pixels B may be combined into six kinds of pixel units PU1 to PU6 according to sequences of arrangement of the first color sub-pixels R, the second color sub-pixels G, and the third color sub-pixels B. In addition, the first color sub-pixels R, the second color sub-pixels G, and the third color sub-pixels B in the six kinds of pixel units PU1 to PU6 have different sequences of arrangement.

It should be noted that each of the unit regions U includes at least three of the six kinds of pixel units PU1 to PU6, such that a pitch of at least one kind of the color sub-pixels has at least four kinds of distances in any of the rows, and a pitch of each of other kinds of color sub-pixels has at least two kinds of distances. In addition, the pitch is between 1/3P to 5/3P. For example, in this embodiment, the unit region U includes the pixel units PU1, PU4, PU1, and PU3 sequentially arranged along the first direction D1, as shown in a region 102A (including two of the unit regions U) of FIG. 3. Namely, the unit region U in FIG. 3 includes four of the pixels PR. The four pixels PR are formed of the three kinds of pixel units PU1, PU4, and PU3, and two of the pixels PR are the same. Thus, in any of the rows, a first pitch 110 between any one of the first color sub-pixels R and a next of the first color sub-pixels R has four kinds of distances 110*a* to 110*d*. In addition, the distances 110*a* to 110*d* are respectively 5/3P, 1/3P, 4/3P, and 2/3P. A second pitch 120 between any one of the second color sub-pixels G and a next of the second color sub-pixels G has two kinds of distances 120*a* and 120*b*. In addition, the distances 120*a* and 120*b* are respectively 2/3P and 4/3P. A third pitch 130 between any one of the third color sub-pixels B and a next of the third color sub-pixels B has three kinds of distances 130*a* to 130*c*. In addition, the distances 130*a* to 130*c* are respectively 2/3P, 4/3P, and 3/3 P. Since the sub-pixels of the same color in the display panel 100 of the invention have a pitch with a plurality of different kinds of distances (also, one kind of color sub-pixels has a pitch with at least four kinds of distances), instead of a pitch with a unified distance, the design that the pitch has different kinds of distances may prevent a background light passing through the sub-pixels of the same color and causing interference or diffraction that results in a blurred background image when the display panel 100 is a transparent display panel. Thus, a design of color arrangement of the sub-pixels of the invention allows the image to be clearer, so as to improve a transmittance and clarity of the display panel 100.

It should also be noted that FIG. 3 illustrates that the unit region U includes one row and a plurality of columns as an example. However, the invention is not limited thereto. In other embodiments, it is also plausible that the unit region U includes a plurality of rows and one column, or a plurality of rows and columns.

Figure 4A:
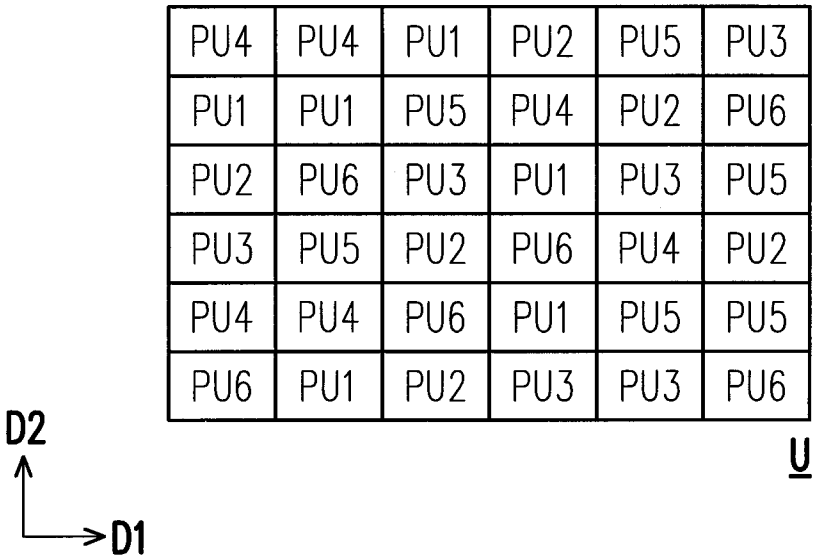

For example, as shown in the unit region U in FIG. 4A, the six kinds of pixel units PU1 to PU6 are arbitrarily arranged along the first direction D1 and the second direction D2 to form a plurality of columns and a plurality of rows. In addition, pixel units in the same column (e.g. the pixel units PU4, PU1, PU2, PU3, PU4, and PU6 in the leftmost column) are arranged into a strip. Also, in this embodiment, the first color sub-pixels R, the second color sub-pixels G, and the third color sub-pixels B are arranged along the first direction D1 and the second direction D2 to form the plurality of columns and rows. In addition, the first color sub-pixels R, the second color sub-pixels G, and the third color sub-pixels B are arranged along the second direction D2 in a strip arrangement, for example. However, the invention is not limited thereto. In other embodiments, such as the unit region U shown in FIG. 4B, the six kinds of pixel units PU1 to PU6 are arbitrarily arranged along the first direction D1 and the second direction D2 to form more columns and more rows. In addition, pixel units of the same column are arranged into a strip. Therefore, the invention does not limit a number of columns and a number of rows in each of the unit regions U.

Figure 5B:
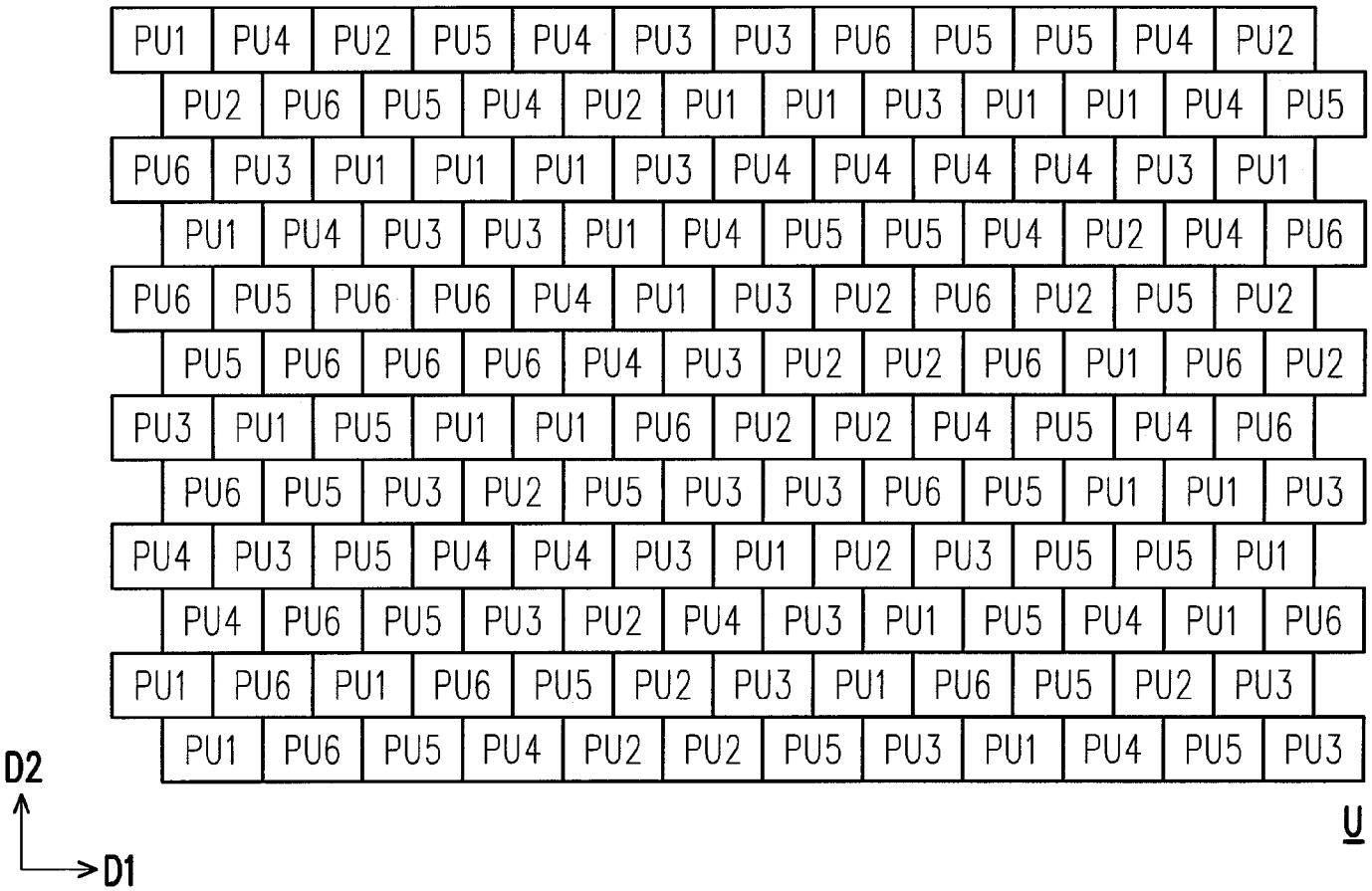

Another example is that, as shown in the unit region U in FIG. 5A, the six kinds of pixel units PU1 to PU6 are arbitrarily arranged along the first direction D1 and the second direction D2 to form a plurality of columns and a plurality of rows. In addition, pixel units in the same column (e.g. the pixel units PU4, PU1, PU2, PU3, PU4, and PU6 in the leftmost column) are in a delta arrangement. Also, in this embodiment, the first color sub-pixels R, the second color sub-pixels G, and the third color sub-pixels B are arranged along the first direction D1 and the second direction D2 to form the plurality of columns and rows. In addition, the first color sub-pixels R, the second color sub-pixels G, and the third color sub-pixels B are arranged along the second direction D2 in a delta arrangement, for example. However, the invention is not limited thereto. In other embodiments, such as the unit region U shown in FIG. 5B, the six kinds of pixel units PU1 to PU6 are arbitrarily arranged along the first direction D1 and the second direction D2 to form more columns and more rows. In addition, pixel units of the same column are in the delta arrangement. Accordingly, the invention does not limit the number of columns and the number of rows in each of the unit regions U. According to the above, based on one embodiment of the invention, any two rows in each of the unit regions U may be arranged to be aligned, as shown in FIGS. 4A and 4B, or to be not aligned, as shown in FIGS. 5A and 5B. In addition, the non-aligned arrangement includes shifting a distance of 1/6P, 1/3P, 2/3P or other appropriate kinds of distances along the first direction D1 to form the strip or delta arrangement.

The embodiment shown in FIGS. 1-3 is exemplified with the unit region U including three kinds of pixel units and having four pixel units. However, the invention is not limited thereto. In other embodiments, it may also be that the unit region U includes three or more kinds of pixel units and having four or more pixel units, provided that a pitch of at least one kind of the color sub-pixels has at least four kinds of distances in any of the rows.

Figure 6:
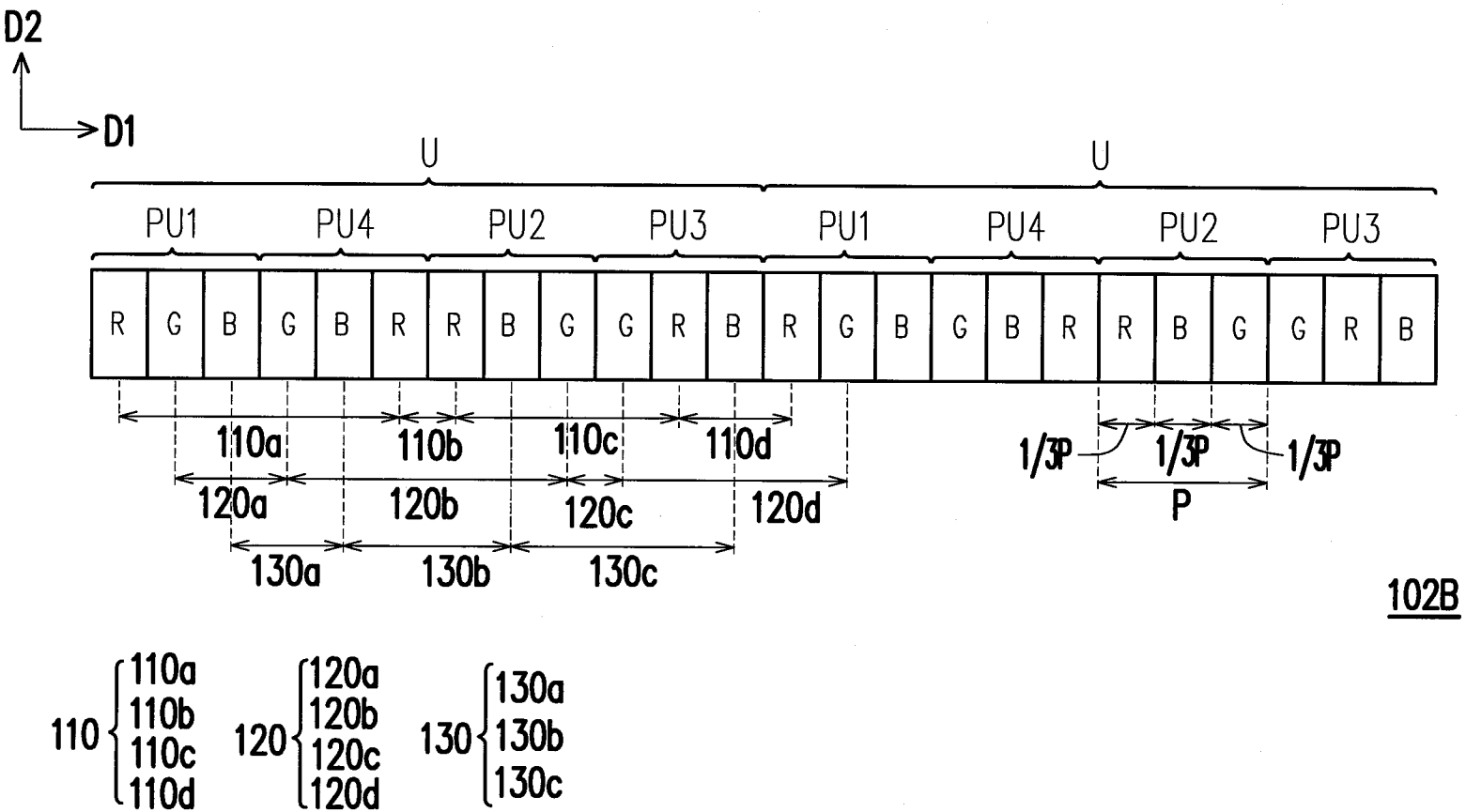
FIG. 6 is a schematic top view of a unit region according to a second embodiment of the invention.

FIG. 6 is a schematic top view of a unit region according to a second embodiment of the invention. The embodiment shown in FIG. 6 is similar to the embodiment shown in FIGS. 1-3. Thus, same or similar components are represented by same or similar symbols and the description thereof will not be reiterated hereinafter. The embodiment shown in FIG. 6 and the embodiment shown in FIGS. 1-3 differ in that the unit region U includes four kinds of pixel units and has four pixel units. More specifically, as shown in a region 102B (including two of the unit regions U) of FIG. 6, the unit region U includes the pixel units PU1, PU4, PU2, and PU3 sequentially arranged along the first direction D1. Namely, the unit region U in FIG. 6 includes four of the pixels PR. The four pixels PR are formed of the four kinds of pixel units PU1, PU4, PU2, and PU3, and each of the pixels PR is different from each other. Thus, in any of the rows, the first pitch 110 between any one of the first color sub-pixels R and a next of the first color sub-pixels R has four kinds of distances 110*a* to 110*d*. In addition, the distances 110*a* to 110*d* are respectively 5/3P, 1/3P, 4/3P, and 2/3P. The second pitch 120 between any one of the second color sub-pixels G and a next of the second color sub-pixels G has four kinds of distances 120*a* to 120*d*. In addition, the distances 120*a* to 120*d* are respectively 2/3P, 5/3P, 1/3P, and 4/3P. The third pitch 130 between any one of the third color sub-pixels B and a next of the third color sub-pixels B has three kinds of distances 130*a* to 130*c*. In addition, the distances 130*a* to 130*c* are respectively 2/3P, 3/3P, and 4/3P.

Figure 7:
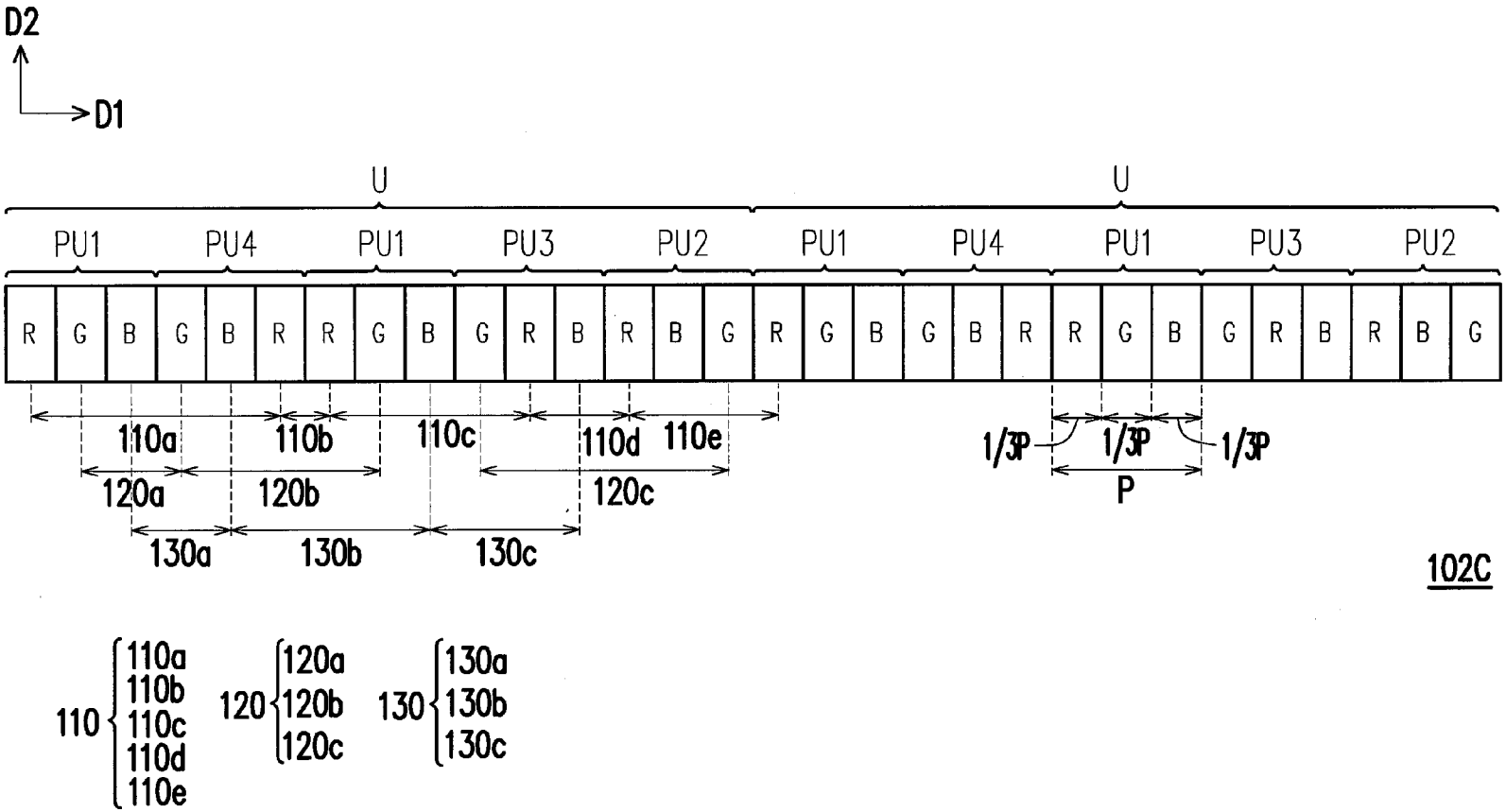
FIG. 7 is a schematic top view of a unit region according to a third embodiment of the invention.

FIG. 7 is a schematic top view of a unit region according to a third embodiment of the invention. The embodiment shown in FIG. 7 is similar to the embodiment shown in FIGS. 1-3. Thus, same or similar components are represented by same or similar symbols and the description thereof will not be reiterated hereinafter. The embodiment shown in FIG. 7 and the embodiment shown in FIGS. 1-3 differ in that the unit region U includes four kinds of pixel units and has five pixel units. More specifically, as shown in a region 102C (including two of the unit regions U) of FIG. 7, the unit region U includes the pixel units PU1, PU4, PU1, PU3, and PU2 sequentially arranged along the first direction D1. Namely, the unit region U in FIG. 7 includes five of the pixels PR. The five pixels PR are formed of the four kinds of pixel units PU1, PU4, PU3, and PU2, and two of the pixels PR are the same. Thus, in any of the rows, the first pitch 110 between any one of the first color sub-pixels R and a next of the first color sub-pixels R has five kinds of distances 110*a* to 110*e*. In addition, the distances 110*a* to 110*e* are respectively 5/3P, 1/3P, 4/3P, 2/3P, and 3/3P. The second pitch 120 between any one of the second color sub-pixels G and a next of the second color sub-pixels G has three kinds of distances 120*a* to 120*c*. In addition, the distances 120*a* to 120*c* are respectively 2/3P, 4/3P, and 5/3P. The third pitch 130 between any one of the third color sub-pixels B and a next of the third color sub-pixels B has three kinds of distances 130*a* to 130*c*. In addition, the distances 130*a* to 130*c* are respectively 2/3P, 4/3P, and 3/3P.

Figure 8:
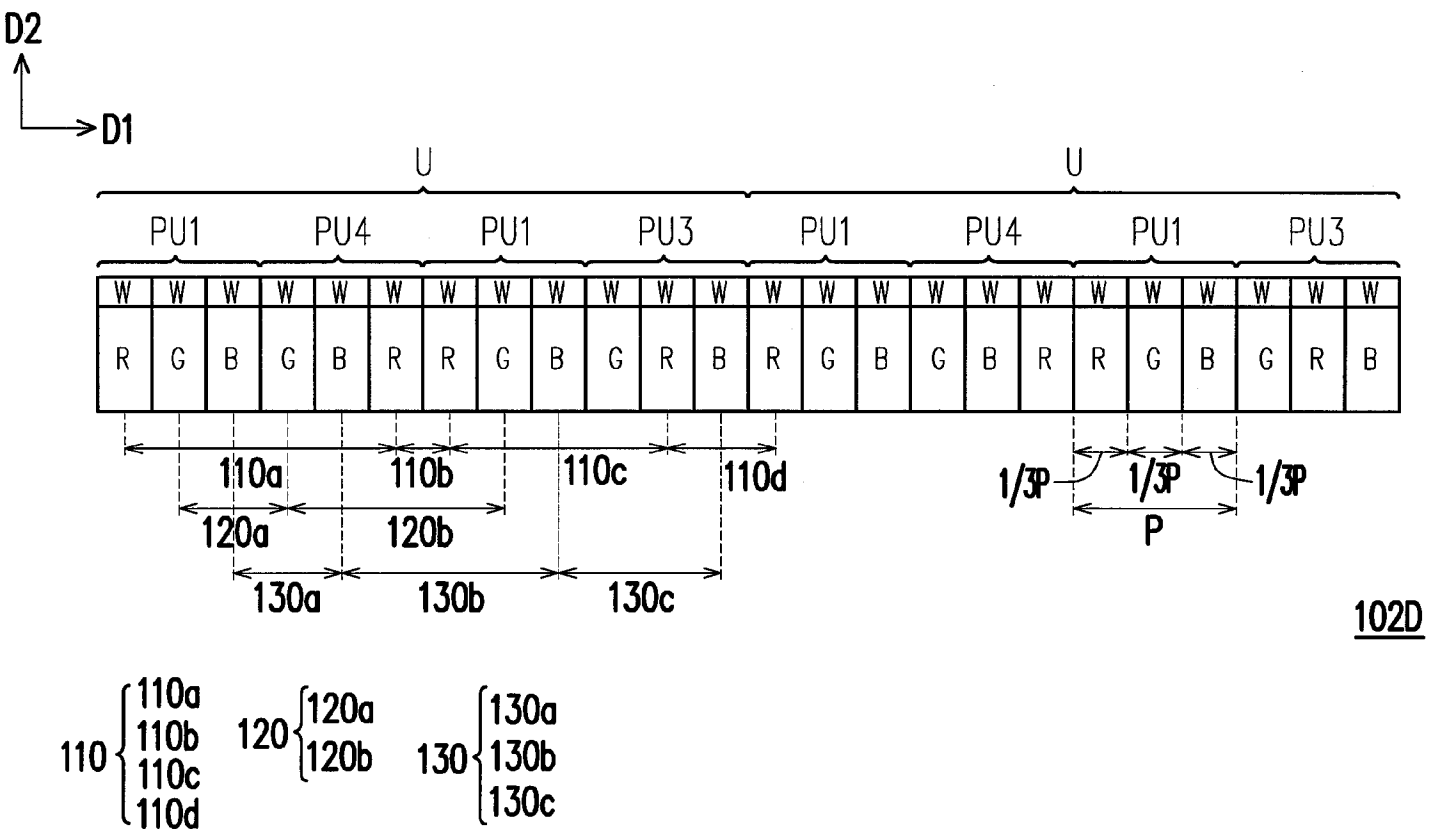
FIG. 8 is a schematic top view of a unit region according to a fourth embodiment of the invention.

FIG. 8 is a schematic top view of a unit region according to a fourth embodiment of the invention. The embodiment shown in FIG. 8 is similar to the embodiment shown in FIGS. 1-3. Thus, same or similar components are represented by same or similar symbols and the description thereof will not be reiterated hereinafter. The embodiment shown in FIG. 8 and the embodiment shown in FIGS. 1-3 differ in that each of the color sub-pixels further includes a white light sub-pixel region. More specifically, as shown in a region 102D (including two of the unit regions U) of FIG. 8, the unit region U includes the pixel units PU1, PU4, PU1, and PU3 sequentially arranged along the first direction D1. Namely, the unit region U in FIG. 8 includes four of the pixels PR. The four pixels PR are formed of the three kinds of pixel units PU1, PU4, and PU3, and two of the pixels PR are the same. Furthermore, each of the first color sub-pixels R, each of the second color sub-pixels G, and each of the third color sub-pixels B further include a white light sub-pixel region W, respectively.

The embodiments shown in FIGS. 1-8 are exemplified with the unit region U including three kinds of color sub-pixels. However, the invention is not limited thereto. In other embodiments, it may also be that the unit region U includes three or more kinds of color sub-pixels, provided that a pitch of at least one kind of the color sub-pixels has at least four kinds of distances in any of the rows.

Figure 9A:
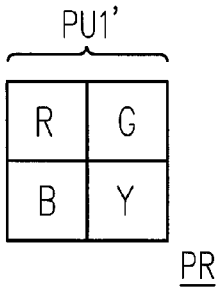
FIGS. 9A to 9X are schematic top views of 24 kinds of pixel units according to a fifth embodiment of the invention.
Figure 9B:
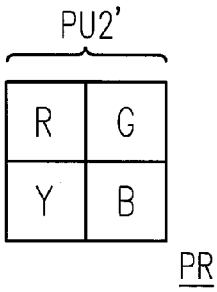
Figure 9C:
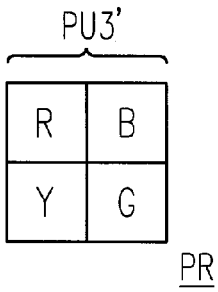
Figure 9D:
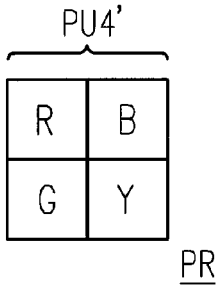
Figure 9E:
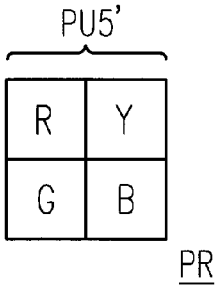
Figure 9F:
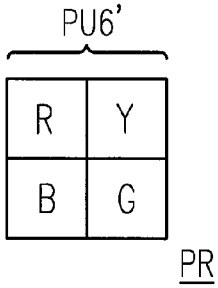
Figure 9G:
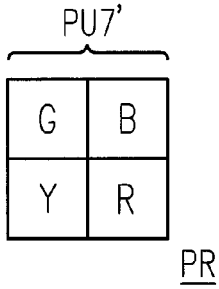
Figure 9H:
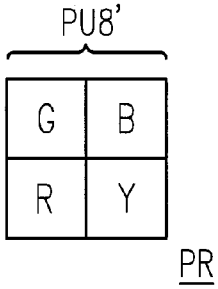
Figure 9I:
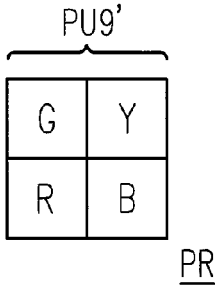
Figure 9J:
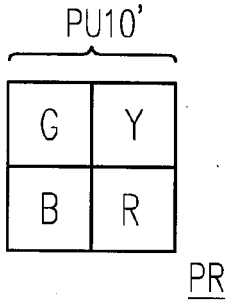
Figure 9K:
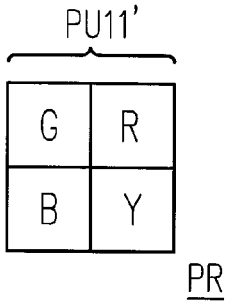
Figure 9L:
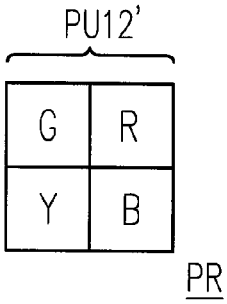
Figure 9M:
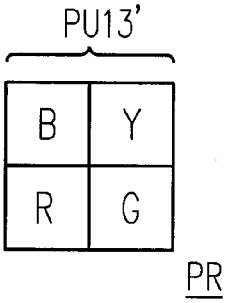
Figure 9N:
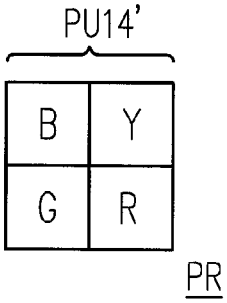
Figure 9O:
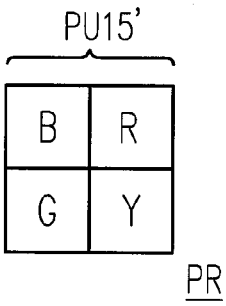
Figure 9P:
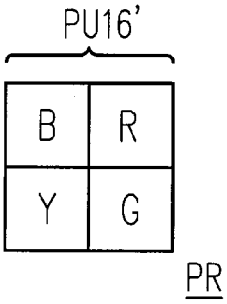
Figure 9Q:
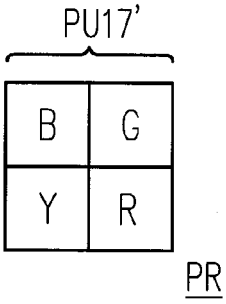
Figure 9R:
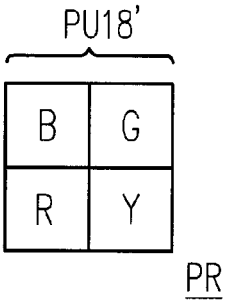
Figure 9S:
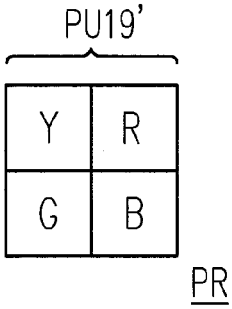
Figure 9T:
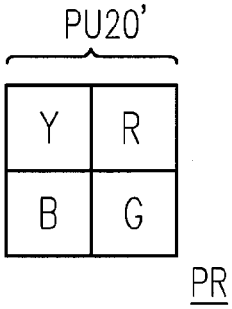
Figure 9U:
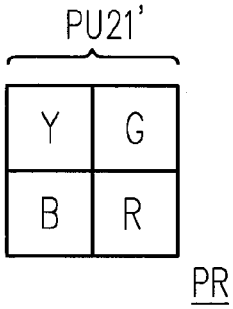
Figure 9V:
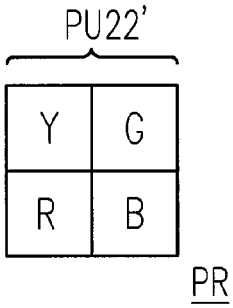
Figure 9W:
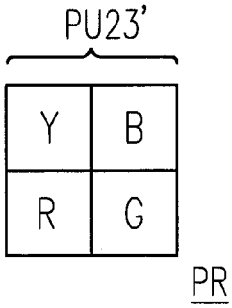
Figure 9X:
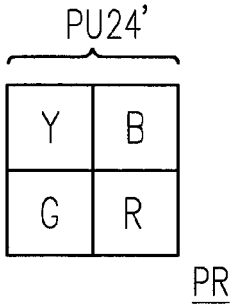
Figure 10:
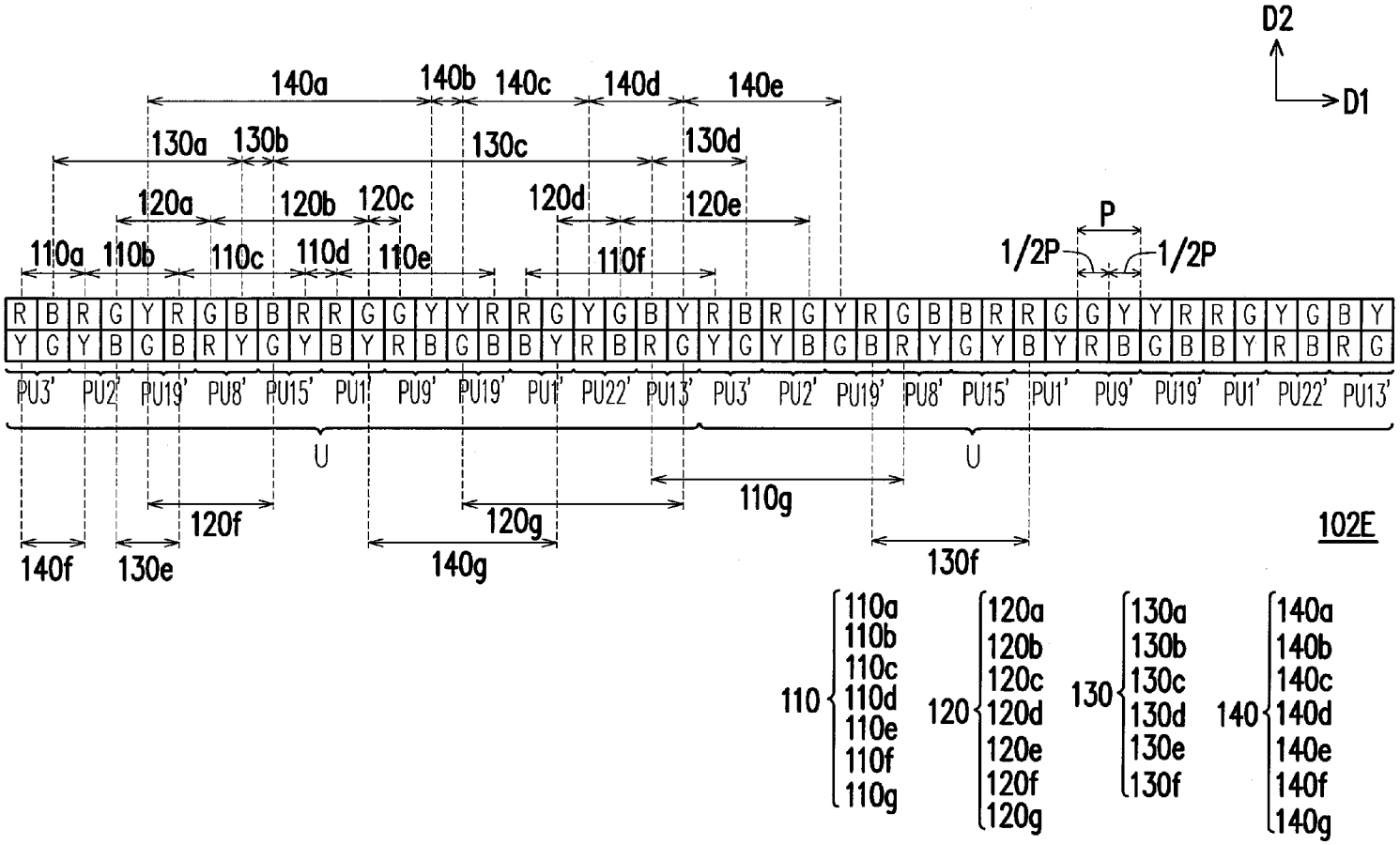
Figure 12:
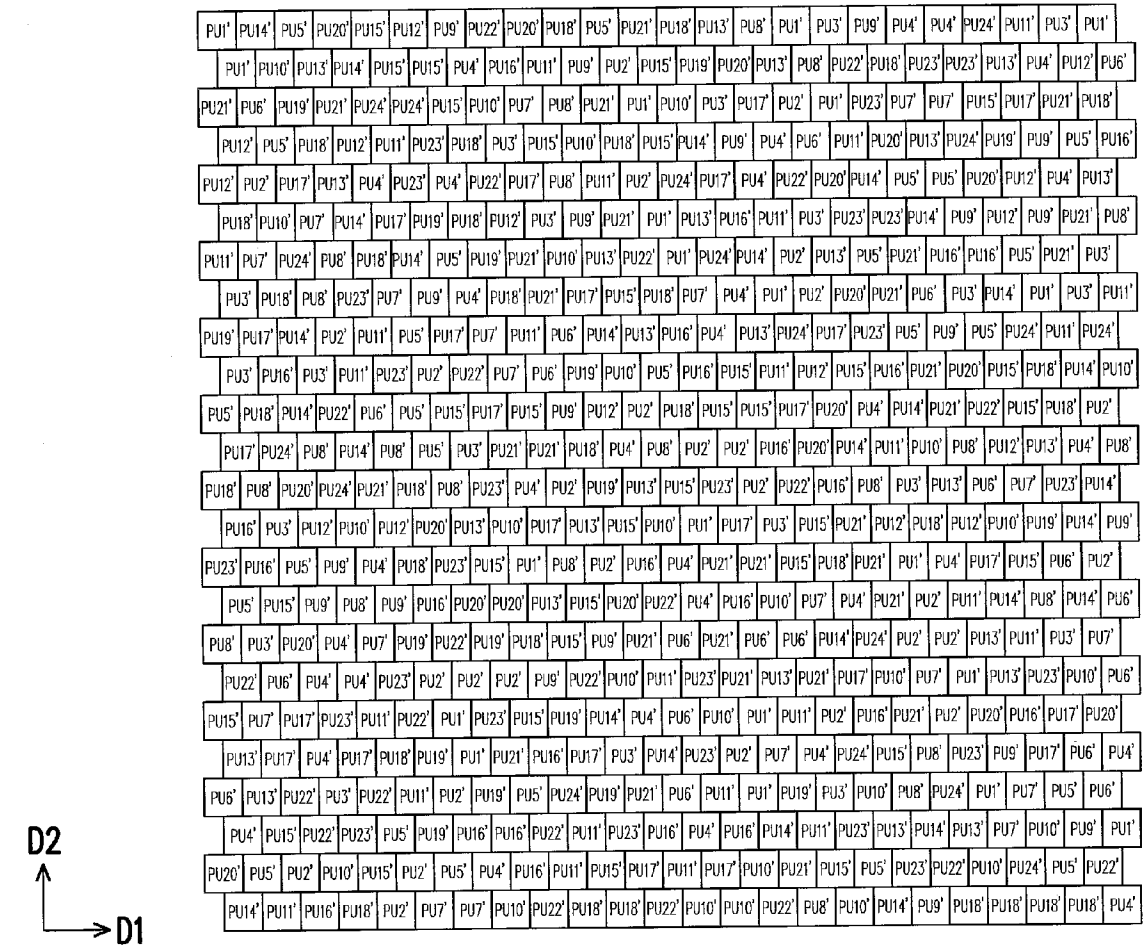

FIGS. 9A to 9X are schematic top views of 24 kinds of pixel units according to a fifth embodiment of the invention. FIGS. 10 to 12 are respectively schematic top views of unit regions formed by the pixel units shown in FIGS. 9A to 9X. The embodiment shown in FIGS. 9A to 12 is similar to the embodiment shown in FIGS. 1 to 5B. Thus, same or similar components are represented by same or similar symbols, and the description thereof will not be reiterated hereinafter. The embodiment shown in FIGS. 9A to 12 and the embodiment shown in FIGS. 1 to 5B differ in that each of the unit regions U further includes a plurality of fourth color sub-pixels.

Referring to FIGS. 9A to 10 simultaneously, each of the unit regions U of the display panel 100 includes the plurality of first color sub-pixels R, the plurality of second color sub-pixels G, the plurality of third color sub-pixels B, and a plurality of fourth color sub-pixels Y. In this embodiment, the first color sub-pixels R, the second color sub-pixels G, the third color sub-pixels B, and the fourth color sub-pixels Y are respectively red sub-pixels, green sub-pixels, blue sub-pixels, and white sub-pixels. However, the invention is not limited thereto. In other embodiments, the first color sub-pixels R, the second color sub-pixels G, the third color sub-pixels B, and the fourth color sub-pixels Y may be other appropriate colors or combinations. For example, the fourth color sub-pixels Y may also be yellow sub-pixels. Furthermore, in this embodiment, one of the first color sub-pixels R, one of the second color sub-pixels G, one of the third color sub-pixels B, and one of the fourth color sub-pixels Y form the pixel PR. In addition, the color sub-pixels are arranged in a 2×2 matrix to from the pixel PR. The length of each of the pixels PR in the first direction D1 is P, and the length of each of the color sub-pixels, including the first color sub-pixels R, the second color sub-pixels G, the third color sub-pixels B, and the fourth color sub-pixel Y, in the first direction D1 is 1/2P. In addition, as shown in FIGS. 9A to 9X, the first color sub-pixels R, the second color sub-pixels G, the third color sub-pixels B, and the fourth color sub-pixels Y may be combined into 24 kinds of pixel units PU1' to PU24' according to sequences of arrangement of the first color sub-pixels R, the second color sub-pixels G, the third color sub-pixels B, and the fourth color sub-pixels Y. In addition, the first color sub-pixels R, the second color sub-pixels G, the third color sub-pixels B, and the fourth color sub-pixels Y in the 24 kinds of pixel units PU1' to PU24' have different sequences of arrangement.

It should be noted that each of the unit regions U includes at least three of the 24 kinds of pixel units PU1' to PU24', such that a pitch of at least one kind of the color sub-pixels has at least four kinds of distances in any of the rows, and a pitch of each of other kinds of color sub-pixels has at least one kind of distance. In addition, the pitch is between 1/2P to 12/2P. For example, in this embodiment, the unit region U includes the pixel units PU3', PU2', PU19', PU8', PU15', PU1', PU9', PU19', PU1', PU22', and PU13' sequentially arranged along the first direction D1, as shown in a region 102E (including two of the unit regions U) of FIG. 10. Namely, the unit region U in FIG. 10 includes 11 of the pixels PR, and the 11 pixels PR are formed of the nine kinds of pixel units PU3', PU2', PU19', PU8', PU15', PU1', PU9', PU22', and PU13', and some of the pixels are the same. Thus, in any of the rows, the first pitch 110 between any one of the first color sub-pixels R and a next of the first color sub-pixels R has seven kinds of distances 110*a* to 110*g*. In addition, the distances 110*a* to 110*g* are respectively 2/2P, 3/2P, 4/2P, 1/2P, 5/2P, 6/2P, and 8/2P. The second pitch 120 between any one of the second color sub-pixels G and a next of the second color sub-pixels G has seven kinds of distances 120*a* to 120*g*. In addition, the distances 120*a* to 120*g* are respectively 3/2P, 5/2P, 1/2P, 2/2P, 6/2P, 4/2P, and 7/2P. The third pitch 130 between any one of the third color sub-pixels B and a next of the third color sub-pixels B has six kinds of distances 130*a* to 130*f*. In addition, the distances 130*a* to 130*f* are respectively 6/2P, 1/2P, 12/2P, 3/2P, 2/2P, and 5/2P. A fourth pitch 140 between any one of the fourth color sub-pixels Y and a next of the fourth color sub-pixels Y has at least seven kinds of distances 140*a* to 140*g*. In addition, the distances 140*a* to 140*g* are respectively 9/2P, 1/2P, 4/2P, 3/2P, 5/2P, 2/2P, and 6/2P.

It should also be noted that FIG. 10 illustrates that the unit region U includes one row and a plurality of columns as an example. However, the invention is not limited thereto. In other embodiments, it is also plausible that the unit region U includes a plurality of rows and one column, or a plurality of rows and columns.

For example, as shown in the unit region U in FIG. 11, the 24 kinds of pixel units PU1' to PU24' are arbitrarily arranged along the first direction D1 and the second direction D2 to form a plurality of columns and a plurality of rows. In addition, pixel units in the same column (e.g. the pixel units PU1', PU1', PU21', PU12', PU12' PU13', PU6', PU4', PU20', and PU14' in the leftmost column) are arranged into a strip. In addition, the first color sub-pixels R, the second color sub-pixels G, the third color sub-pixels B, and the fourth color sub-pixels Y are arranged along the first direction D1 and the second direction D2 in a 2×2 matrix, for example. Furthermore, the invention does not limit the number of columns and the number of rows in each of the unit regions U.

Another example is that, as shown in the unit region U in FIG. 12, the 24 kinds of pixel units PU1' to PU24' are arbitrarily arranged along the first direction D1 and the second direction D2 to form a plurality of columns and a plurality of rows. In addition, pixel units in the same column (e.g. the pixel units PU1', PU1', PU21', PU12', PU12' . . . PU13', PU6', PU4', PU20', and PU14' in the leftmost column) are in a delta arrangement. In addition, the first color sub-pixels R, the second color sub-pixels G, the third color sub-pixels B, and the fourth color sub-pixels Y are arranged along the first direction D1 and the second direction D2 in a 2×2 matrix, for example. Furthermore, the invention does not limit the number of columns and the number of rows in each of the unit regions U. According to the above, based on one embodiment of the invention, any two of the rows in each of the unit regions U may be arranged to be aligned, as shown in FIG. 11, or to be not aligned, as shown in FIG. 12. In addition, the non-aligned arrangement includes shifting a distance of 1/4P, 1/2P, 2/2P or other appropriate kinds of distances along the first direction D1 to form the strip or delta arrangement.

Figure 13A:
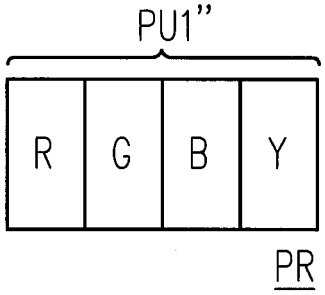
FIGS. 13A to 13X are schematic top views of 24 kinds of pixel units according to a sixth embodiment of the invention.
Figure 13B:
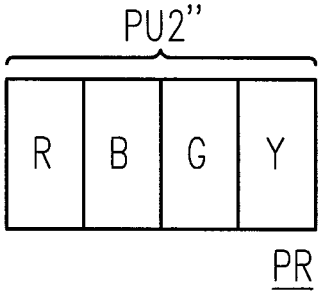
Figure 13C:
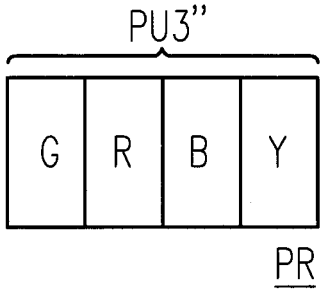
Figure 13D:
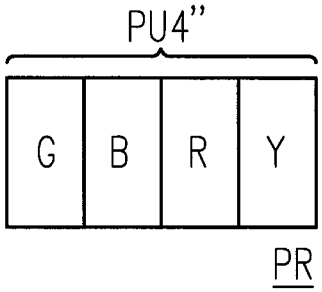
Figure 13E:
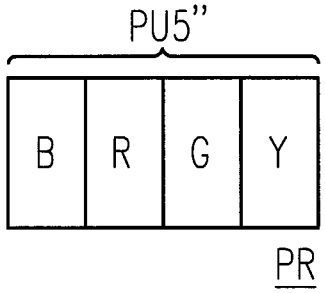
Figure 13F:
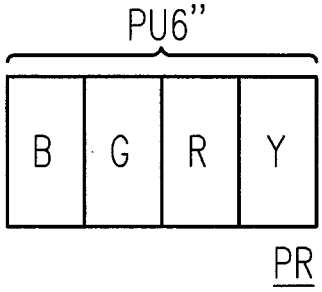
Figure 13G:
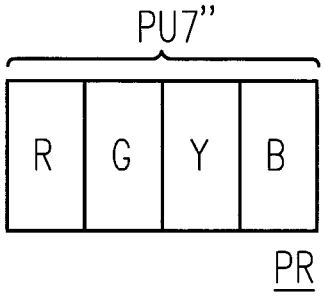
Figure 13H:
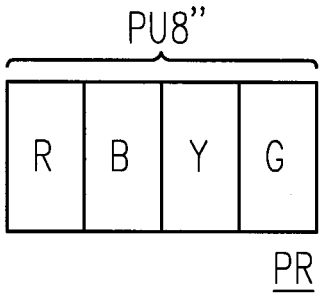
Figure 13I:
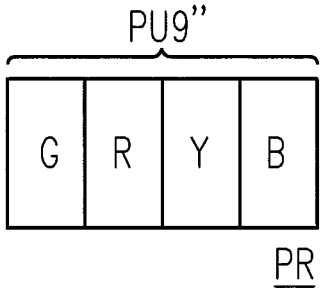
Figure 13J:
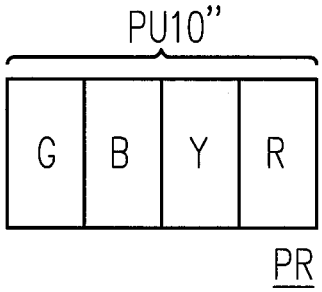
Figure 13K:
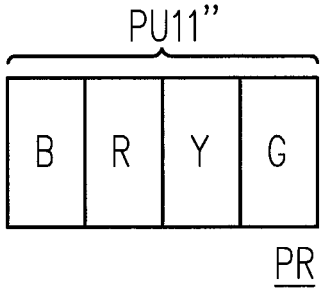
Figure 13L:
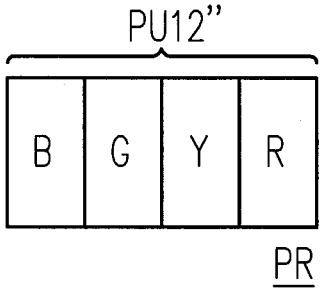
Figure 13M:
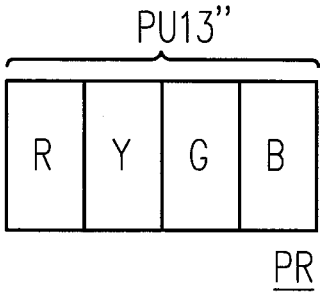
Figure 13N:
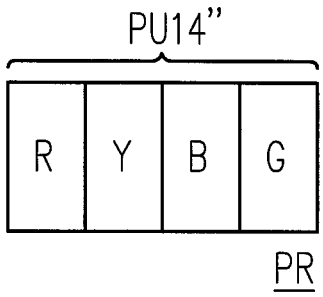
Figure 13O:
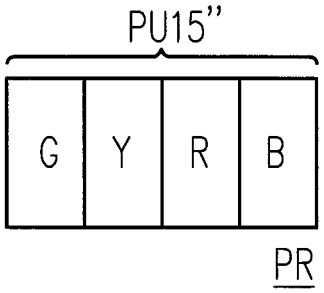
Figure 13P:
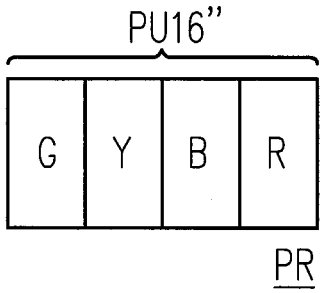
Figure 13Q:
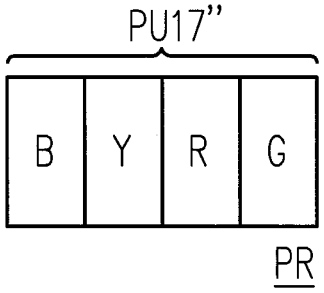
Figure 13R:
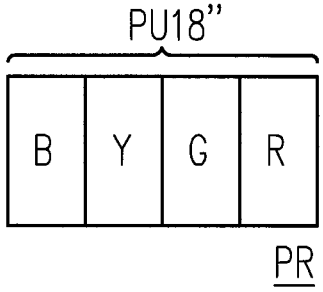
Figure 13S:
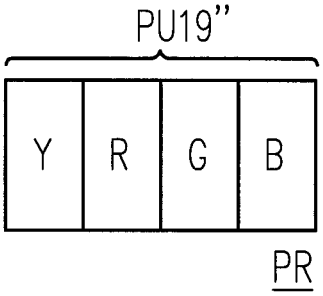
Figure 13T:
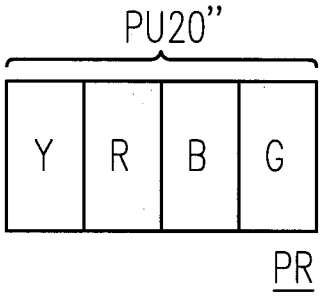
Figure 13U:
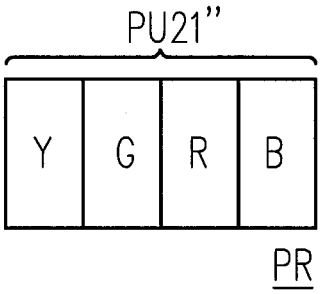
Figure 13V:
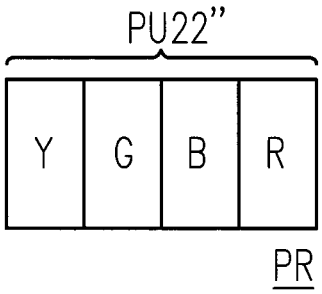
Figure 13W:
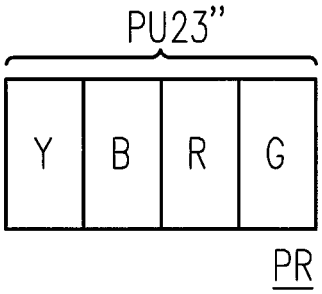
Figure 13X:
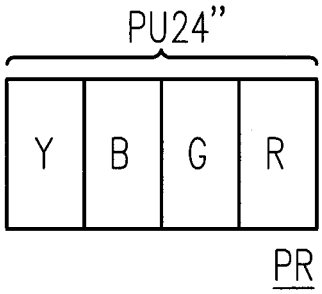
Figure 14:
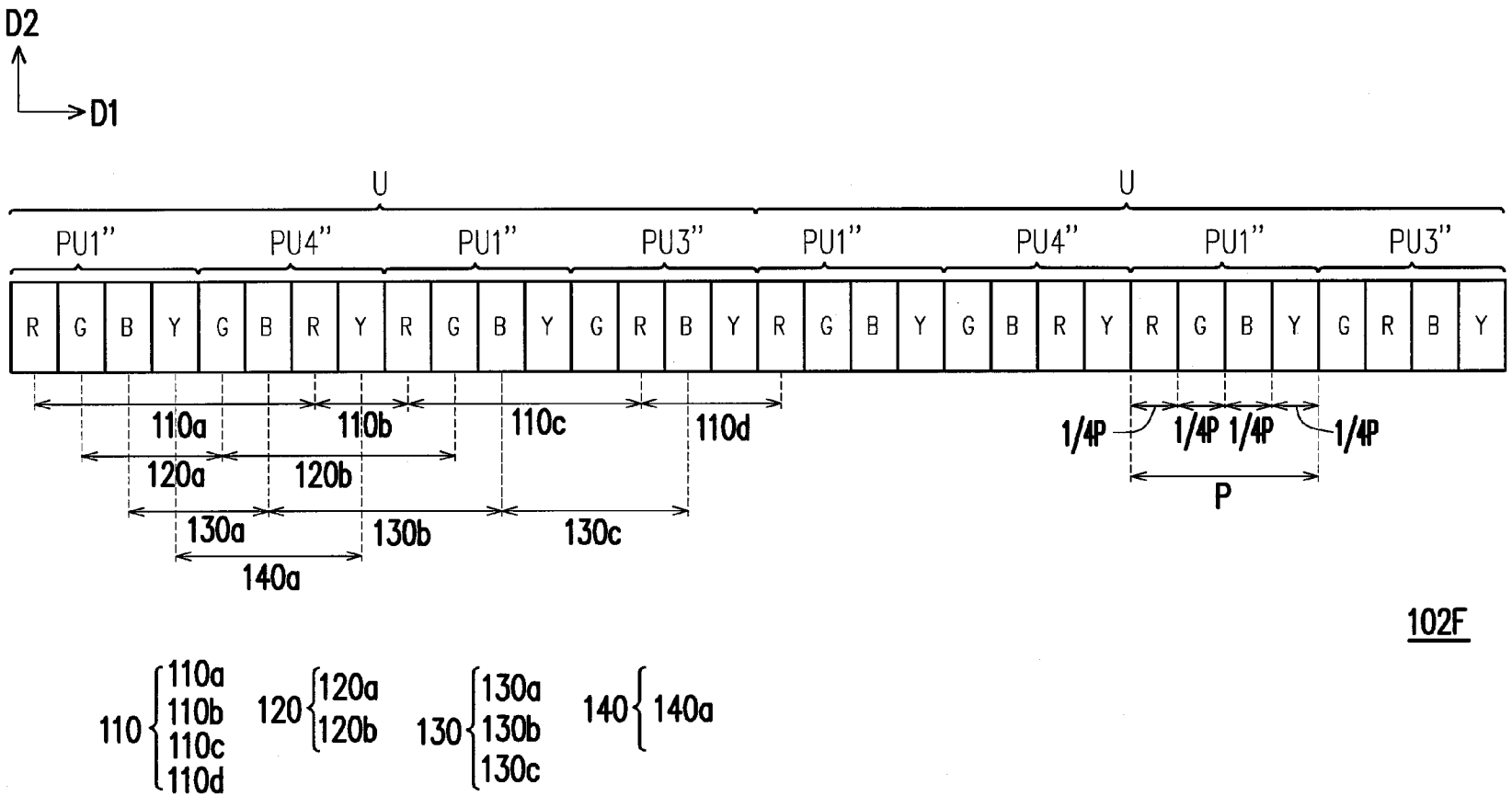
FIG. 14 is a schematic top view of a unit region formed by the pixel units shown in FIGS. 13A to 13X.

FIGS. 13A to 13X are schematic top views of 24 kinds of pixel units according to a sixth embodiment of the invention. FIG. 14 is a schematic top view of a unit region formed by the pixel units shown in FIGS. 13A to 13X. The embodiment shown in FIGS. 13A to 14 is similar to the embodiment shown in FIGS. 1-3. Thus, same or similar components are represented by same or similar symbols, and the description thereof will not be reiterated hereinafter. The embodiment shown in FIGS. 13 A to 14 and the embodiment shown in FIGS. 1 to 3 differ in that each of the unit regions U further includes the plurality of fourth color sub-pixels.

Referring to FIGS. 13A to 14 simultaneously, each of the unit regions U of the display panel 100 includes the plurality of first color sub-pixels R, the plurality of second color sub-pixels G, the plurality of third color sub-pixels B, and the plurality of fourth color sub-pixels Y. In this embodiment, the first color sub-pixels R, the second color sub-pixels G, the third color sub-pixels B, and the fourth color sub-pixels Y are respectively red sub-pixels, green sub-pixels, blue sub-pixels, and white sub-pixels. However, the invention is not limited thereto. In other embodiments, the first color sub-pixels R, the second color sub-pixels G, the third color sub-pixels B, and the fourth color sub-pixels Y may be other appropriate colors or combinations. For example, the fourth color sub-pixels Y may also be yellow sub-pixels. Furthermore, in this embodiment, one of the first color sub-pixels R, one of the second color sub-pixels G, one of the third color sub-pixels B, and one of the fourth color sub-pixels Y form the pixel PR. In addition, the color sub-pixels are arranged along the first direction D1 to from the pixel PR. The length of each of the pixels PR in the first direction D1 is P, and the length of each of the color sub-pixels, including the first color sub-pixels R, the second color sub-pixels G, the third color sub-pixels B, and the fourth color sub-pixel Y, in the first direction D1 is 1/4P. In addition, the first color sub-pixels R, the second color sub-pixels G, the third color sub-pixels B, and the fourth color sub-pixels Y may be combined into 24 kinds of pixel units PU1" to PU24" according to the sequences of arrangement of the first color sub-pixels R, the second color sub-pixels G, the third color sub-pixels B, and the fourth color sub-pixels Y. In addition, the first color sub-pixels R, the second color sub-pixels G, the third color sub-pixels B, and the fourth color sub-pixels Y in the 24 kinds of pixel units PU1" to PU24" have different sequences of arrangement.

It should be noted that each of the unit regions U includes at least three of the 24 kinds of pixel units PU1" to PU24", such that a pitch of at least one kind of the color sub-pixels has at least four kinds of distances in any of the rows, and a pitch of each of other kinds of color sub-pixels has at least one kind of distance. In addition, the pitch is between 1/4P to 7/4P. For example, in this embodiment, the unit region U includes the pixel units PU1", PU4", PU1", and PU3" sequentially arranged along the first direction D1, as shown in a region 102F (including two of the unit regions U) of FIG. 13. Namely, the unit region U in FIG. 13 includes four of the pixels PR. The four pixels PR are formed of the three kinds of pixel units PUP, PU4", and PU3", and two of the pixels PR are the same. Thus, in any of the rows, the first pitch 110 between any one of the first color sub-pixels R and a next of the first color sub-pixels R has four kinds of distances 110*a* to 110*d*. In addition, the distances 110*a* to 110*d* are respectively 6/4P, 2/4P, 5/4P, and 3/4P. The second pitch 120 between any one of the second color sub-pixels G and a next of the second color sub-pixels G has two kinds of distances 120*a* and 120*b*. In addition, the distances 120*a* and 120*b* are respectively 3/4P and 5/4P. The third pitch 130 between any one of the third color sub-pixels B and a next of the third color sub-pixels B has three kinds of distances 130*a* to 130*c*. In addition, the distances 130*a* to 130*c* are respectively 3/4P, 5/4P, and 4/4P. The fourth pitch 140 between any one of the fourth color sub-pixels Y and a next of the fourth color sub-pixels Y has one kind of distance 140*a*. In addition, the distance 140*a* is 4/4P.

It should also be noted that FIG. 13 illustrates that the unit region U includes one row and a plurality of columns as an example. However, the invention is not limited thereto. In other embodiments, it is also plausible that the unit region U includes a plurality of rows and one column, or a plurality of rows and columns.

For example, in other embodiments (not shown), the 24 kinds of pixel units PU1 "to PU24" are arbitrarily arranged along the first direction D1 and the second direction D2 to form a plurality of columns and a plurality of rows. In addition, pixel units of the same column are in a strip or delta arrangement. Furthermore, in this embodiment, the first color sub-pixels R, the second color sub-pixels G, the third color sub-pixels B, and the fourth color sub-pixels Y are arranged along the first direction D1 and the second direction D2 to form a plurality of columns and a plurality of rows. In addition, the first color sub-pixels R, the second color sub-pixels G, the third color sub-pixels B, and the fourth color sub-pixels Y are arranged along the second direction D2 in a strip or delta arrangement, for example. Besides, the invention does not limit the number of columns and the number of rows in each of the unit regions U. According to the above, based on one embodiment of the invention, any two of the rows in each of the unit regions U may be arranged to be aligned or to be not aligned. In addition, the non-aligned arrangement includes shifting a distance of 1/8P, 1/4P, 2/4P or other appropriate kinds of distances along the first direction D1 to form the strip or delta arrangement.

In view of the above, in any of the rows in the display panel of the invention, the first pitch between any one of the first color sub-pixels and a next of the first color sub-pixels has at least four kinds of distances. Since the sub-pixels of the same color in the display panel of the invention have the pitch with a plurality of different kinds of distances (and one kind of the color sub-pixels has the pitch with at least four kinds of distances), instead of a pitch with a unified distance, it is possible to prevent the background light passing through the sub-pixels of the same color and causing interference or diffraction that results in a blurred background image. Thus, the design of color arrangement of the sub-pixels of the invention allows the image to be clearer, so as to improve the transmittance and clarity of the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising a plurality of unit regions arranged along a first direction and a second direction to form a plurality of columns and a plurality of rows, each of the unit regions of the display panel comprising:

a plurality of first color sub-pixels, a plurality of second color sub-pixels, and a plurality of third color sub-pixels, wherein in any of the rows, a first pitch between any one of the first color sub-pixels and a next of the first color sub-pixels in the first direction has at least four kinds of distances.

2. The display panel as claimed in claim 1, wherein one of the first color sub-pixels, one of the second color sub-pixels, and one of the third color sub-pixels form a pixel, and the first color sub-pixel, the second color sub-pixel, and the third color sub-pixel are combined into six kinds of pixel units according to sequences of arrangement of the first color sub-pixel, the second color sub-pixel, and the third color sub-pixel, and the first color sub-pixel, the second color sub-pixel, and the third color sub-pixel in the six kinds of pixel units have different sequences of arrangement.

3. The display panel as claimed in claim 2, wherein each of the unit regions comprises at least three of the six kinds of pixel units.

4. The display panel as claimed in claim 1, wherein in any of the rows, a second pitch between any one of the second color sub-pixels and a next of the second color sub-pixels has at least two kinds of distances, and a third pitch between any one of the third color sub-pixels and a next of the third color sub-pixels has at least two kinds of distances.

5. The display panel as claimed in claim 2, wherein a length of each of the pixels in the first direction is P, the first color sub-pixel, the second color sub-pixel, and the third color sub-pixel are in a stripe arrangement or a delta arrangement, a length of the first color sub-pixel, a length of the second color sub-pixel, and a length of the third color sub-pixel in the first direction are respectively 1/3P, and the first pitch between the any one of the first color sub-pixels and the next of the first color sub-pixels in the first direction is between 1/3P to 5/3P.

6. The display panel as claimed in claim 1, wherein each of the unit regions further comprises a plurality of fourth color sub-pixels, wherein one of the first color sub-pixels, one of the second color sub-pixels, one of the third color sub-pixels, and one of the fourth color sub-pixels form a pixel, and the first color sub-pixel, the second color sub-pixel, the third color sub-pixel, and the fourth color sub-pixel are combined into 24 kinds of pixel units according to sequences of arrangement of the first color sub-pixel, the second color sub-pixel, the third color sub-pixel, and the fourth color sub-pixel, and the first color sub-pixel, the second color sub-pixel, the third color sub-pixel, and the fourth color sub-pixel in the 24 kinds of pixel units have different sequences of arrangement.

7. The display panel as claimed in claim 6, wherein in any of the rows, a second pitch between any one of the second color sub-pixels and a next of the second color sub-pixels has at least one kind of distance, a third pitch between any one of the third color sub-pixels and a next of the third color sub-pixels has at least one kind of distance, and a fourth pitch between any one of the fourth color sub-pixels and a next of the fourth color sub-pixels has at least one kind of distance.

8. The display panel as claimed in claim 6, wherein a length of each of the pixels in the first direction is P, the first color sub-pixel, the second color sub-pixel, the third color sub-pixel, and the fourth color sub-pixel are in a stripe arrangement or a delta arrangement, and a length of the first color sub-pixel, a length of the second color sub-pixel, a length of the third color sub-pixel, and a length of the fourth color sub-pixel in the first direction are respectively 1/4P, and the first pitch between the any one of the first color sub-pixels and the next of the first color sub-pixels in the first direction is between 1/4P to 7/4P.

9. The display panel as claimed in claim 6, wherein a length of each of the pixels in the first direction is P, the first color sub-pixel, the second color sub-pixel, the third color sub-pixel, and the fourth color sub-pixel are in a 2×2 matrix arrangement, and a length of the first color sub-pixel, a length of the second color sub-pixel, a length of the third color sub-pixel, and a length of the fourth color sub-pixel in the first direction are respectively 1/2 P, and the first pitch between the any one of the first color sub-pixels and the next of the first color sub-pixels in the first direction is between 1/2 P to 12/2 P.

10. A display panel, comprising a plurality of unit regions arranged along a first direction and a second direction to form a plurality of columns and a plurality of rows, each of the unit regions of the display panel comprising:

a plurality of first color sub-pixels, a plurality of second color sub-pixels, and a plurality of third color sub-pixels, wherein one of the first color sub-pixels, one of the second color sub-pixels, and one of the third color sub-pixels form a pixel, and the first color sub-pixel, the second color sub-pixel, and the third color sub-pixel are combined into six kinds of pixel units according to sequences of arrangement of the first color sub-pixel, the second color sub-pixel, and the third color sub-pixel, and the first color sub-pixel, the second color sub-pixel, and the third color sub-pixel in the six kinds of pixel units have different sequences of arrangement, and in any of the rows, a first pitch between any one of the first color sub-pixels and a next of the first color sub-pixels has at least four kinds of distances.

11. The display panel as claimed in claim 1, wherein each of the unit regions comprises at least three of the six kinds of pixel units.

12. The display panel as claimed in claim 1, wherein in any of the rows, a second pitch between any one of the second color sub-pixels and a next of the second color sub-pixels has at least two kinds of distances, and a third pitch between any one of the third color sub-pixels and a next of the third color sub-pixels has at least two kinds of distances.

13. The display panel as claimed in claim 1, wherein a length of each of the pixels in the first direction is P, the first color sub-pixel, the second color sub-pixel, and the third color sub-pixel are in a stripe arrangement or a delta arrangement, a length of the first color sub-pixel, a length of the second color sub-pixel, and a length of the third color sub-pixel in the first direction are respectively 1/3P, and the first pitch between the any one of the first color sub-pixels and the next of the first color sub-pixels in the first direction is between 1/3P to 5/3P.

14. The display panel as claimed in claim 1, wherein each of the first color sub-pixels, each of the second color sub-pixels, and each of the third color sub-pixels further comprise a white light sub-pixel region, respectively.

15. A display panel, comprising a plurality of unit regions arranged along a first direction and a second direction to form a plurality of columns and a plurality of rows, each of the unit regions of the display panel comprising:

a plurality of first color sub-pixels, a plurality of second color sub-pixels, and a plurality of third color sub-pixels, wherein in any of the rows, a first pitch between any one of the first color sub-pixels and a next of the first color sub-pixels has at least four kinds of distances, wherein each of the unit regions further comprises a plurality of fourth color sub-pixels, wherein one of the first color sub-pixels, one of the second color sub-pixels, one of the third color sub-pixels, and one of the fourth color sub-pixels form a pixel, and the first color sub-pixel, the second color sub-pixel, the third color sub-pixel, and the fourth color sub-pixel are combined into 24 kinds of pixel units according to sequences of arrangement of the first color sub-pixel, the second color sub-pixel, the third color sub-pixel, and the fourth color sub-pixel, and the first color sub-pixel, the second color sub-pixel, the third color sub-pixel, and the fourth color sub-pixel in the 24 kinds of pixel units have different sequences of arrangement.

16. The display panel as claimed in claim 15, wherein each of the unit regions comprises at least three of the 24 kinds of pixel units.

17. The display panel as claimed in claim 15, wherein in any of the rows, a second pitch between any one of the second color sub-pixels and a next of the second color sub-pixels has at least one kind of distance, a third pitch between any one of the third color sub-pixels and a next of the third color sub-pixels has at least one kind of distance, and a fourth pitch between any one of the fourth color sub-pixels and a next of the fourth color sub-pixels has at least one kind of distance.

18. The display panel as claimed in claim 15, wherein a length of each of the pixels in the first direction is P, the first color sub-pixel, the second color sub-pixel, the third color sub-pixel, and the fourth color sub-pixel are in a stripe arrangement or a delta arrangement, and a length of the first color sub-pixel, a length of the second color sub-pixel, a length of the third color sub-pixel, and a length of the fourth color sub-pixel in the first direction are respectively 1/4P, and the first pitch between the any one of the first color sub-pixels and the next of the first color sub-pixels in the first direction is between 1/4P to 7/4P.

19. The display panel as claimed in claim 15 wherein a length of each of the pixels in the first direction is P, the first color sub-pixel, the second color sub-pixel, the third color sub-pixel, and the fourth color sub-pixel are in a 2×2 matrix arrangement, and a length of the first color sub-pixel, a length of the second color sub-pixel, a length of the third color sub-pixel, and a length of the fourth color sub-pixel in the first direction are respectively 1/2P, and the first pitch between the any one of the first color sub-pixels and the next of the first color sub-pixels in the first direction is between 1/2P to 12/2P.

* * * * *